United States Patent [19]

Kaminstein

[11] 4,013,289

[45] Mar. 22, 1977

[54] TENNIS RACKET

[76] Inventor: Bernard Kaminstein, 329 Franklin Place, Paramus, N.J. 07652

[22] Filed: Apr. 8, 1976

[21] Appl. No.: 674,826

Related U.S. Application Data

[63] Continuation-in-part of Ser. No. 591,813, June 30, 1975, abandoned, which is a continuation-in-part of Ser. No. 529,705, Dec. 5, 1974, abandoned.

[52] U.S. Cl. ..... 273/73 D

[51] Int. Cl.[2] ..... A63B 51/00

[58] Field of Search ..... 273/29 A, 73 R, 73 C, 273/73 D, 73 E, 73 F, 73 H

[56] References Cited

UNITED STATES PATENTS

| | | | |
|---|---|---|---|
| 323,608 | 8/1885 | Turner | 273/73 D |
| 801,246 | 10/1905 | Johnson | 273/73 D |
| 854,024 | 5/1907 | Brown | 273/73 D |
| 971,773 | 10/1910 | Mueller | 273/73 D |
| 1,173,712 | 2/1916 | DuBois | 273/73 D |
| 1,279,720 | 9/1918 | Lewis | 273/73 D |
| 1,542,177 | 6/1925 | Rose | 273/73 D |
| 1,559,986 | 11/1925 | Quick | 273/73 E |
| 3,545,756 | 12/1970 | Nash | 273/73 D |
| 3,820,785 | 6/1974 | Occhipinti | 273/73 D X |
| 3,884,467 | 5/1975 | Sommer | 273/73 D |

FOREIGN PATENTS OR APPLICATIONS

| | | | |
|---|---|---|---|
| 855,902 | 2/1940 | France | 273/73 D |
| 1,059,989 | 11/1953 | France | 273/73 D |
| 287,775 | 3/1928 | United Kingdom | 273/73 D |
| 300,700 | 11/1928 | United Kingdom | 273/73 D |

*Primary Examiner*—Richard J. Apley
*Attorney, Agent, or Firm*—Lindenberg, Freilich, Wasserman, Rosen & Fernandez

[57] ABSTRACT

A tennis or squash racket is provided wherein, by changing the number of strings in the racket and rearranging their location the shock of the impact of the ball upon the racket is resiliently absorbed over a longer period of time than heretofore, and a better control of the ball is obtained. A center group of vertical strings is provided, wherein the strings are closely spaced about the center of the racket and two strings are positioned on either side of the center group which are further apart in the remaining racket space. There is a horizontal string group closely spaced principally about the center with a fewer number of strings on either side between the horizontal string group and the top and the bottom of the racket.

10 Claims, 10 Drawing Figures

TENNIS RACKET

CROSS-REFERENCE TO RELATED APPLICATIONS

This application is a CIP of an application Ser. No. 591,813, filed on June 30, 1975, and now abandoned which is a CIP of an application Ser. No. 529,705, filed Dec. 5, 1974, and now abandoned.

BACKGROUND OF THE INVENTION

This invention relates to the construction of a tennis racket and more particularly to improvements therein.

The problem of "tennis elbow" arises as a result of the impact of a tennis racket striking a tennis ball, which impact is transmitted with very little absorption, through the tennis racket into the arm of the player. The nylon or gut strings which are used to fill the opening in the tennis racket frame are strung under tension. The strings are effectively arranged to criss cross at right angles and in a woven pattern in the opening of the tennis racket so that a fairly stiff surface is presented for striking the ball. When the ball strikes the center of the racket a good distribution of force occurs. However, as more often happens, when the ball impacts the racket strings near an edge of the racket the impact forces are transmitted substantially undiminished, through the racket and into the arm of the player.

OBJECT AND SUMMARY OF THE INVENTION

It is an object of this invention to provide an improved tennis racket strung in a manner to preserve the playing capability of the racket substantially undiminished while providing for an improved absorption of the forces caused by the impact of the tennis racket on the ball.

Another object of this invention is to provide a tennis racket with improved impact absorption, while maintaining racket performance no matter which portion of the surface area of the racket is used to strike the ball.

The foregoing and other objects of the invention may be achieved by judiciously eliminating a number of the strings with which the tennis racket would otherwise be strung at predetermined locations, yet not eliminating so many strings, so that the force of the ball on the strings can cause a stretching or deformation of the strings beyond their elastic limit. As a result of stringing the tennis racket, in the manner taught in this invention, a tennis ball remains in contact with the strings of the tennis racket over a longer interval of time which reduces the forces which would otherwise be transmitted through the racket into the arm of the holder, since the time for decelerating the motion of the ball in one direction to zero and then accelerating it in the opposite direction is spread over a longer interval.

In a preferred embodiment of the invention, the racket is strung. in a manner so that there is a central vertical group of eight strings, spaced on the order of ⅜ of an inch apart, with two more vertical strings on either side of the central group. These are spaced 1 inch apart from each other and the string nearest the central group of strings is spaced one inch therefrom.

Now considering the horizontal group of strings, there is a total of 16 strings. The top string is spaced 1 inch at the widest spacing from the top of the racket. The next string is ¾ of an inch away from that one. The third from the top string is spaced ⅝ of an inch away from the second from the top. The next 10 strings are spaced between ⅜ to 7/16 of an inch apart. The fourteenth string is ¾ of an inch below the 13th string. The 15th string is ⅞ of an inch below the 14th, and the 16th string is 1 inch below the 15th. The third from the bottom string is tied to the vertical strings which cross it to prevent the strings from sliding and thereby wearing out due to excessive friction.

As a result of restringing the tennis racket in the manner described herein, the tennis ball remains in contact with the strings of the tennis racket over a longer interval of time, which reduces the forces which would otherwise be transmitted through the racket into the arm of the holder, since the time for accelerating the motion of the ball in one direction to zero and then accelerating it in the opposite direction is spread over a longer interval. Furthermore, in view of the fact that the ball is in contact with the strings over a longer interval, more control can be exerted thereover.

The novel features of the invention are set forth with particularity in the appended claims. The invention will best be understood from the following description when read in conjunction with the accompanying drawings.

DESCRIPTION OF THE PREFERRED EMBODIMENTS

Figure 1:
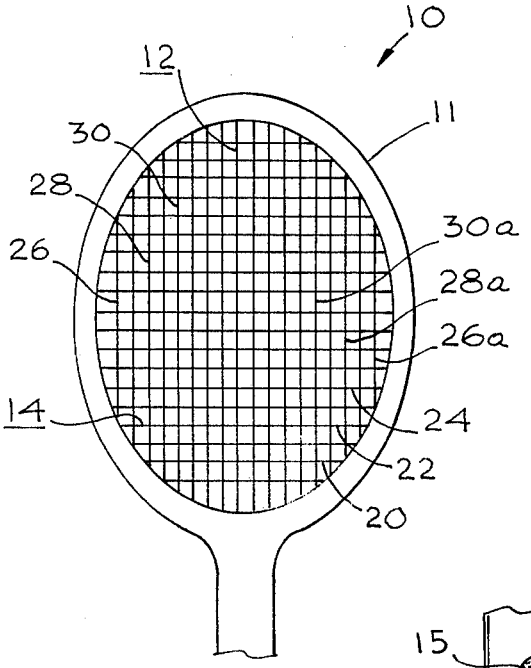
FIG. 1 is a view of the present invention for a tennis racket.

Referring to FIG. 1 of the drawings there is shown the present day construction of a standard tennis racket 10. The racket frame 11, in accordance with recent practice, has substantially 18 vertical strings, 12, and 20 horizontal strings, 14, which are effectively "woven" through the vertical strings. The tension which is applied to the strings, when they are strung on the racket frame 11, is between 40 and 60 pounds and most usually 50 pounds.

Figure 2:
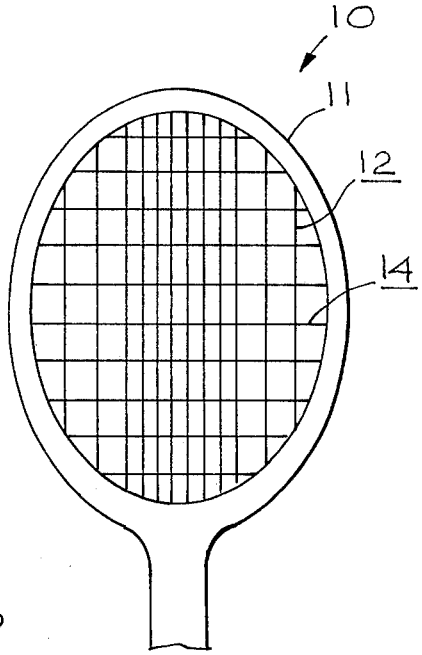
FIG. 2 is a view of a tennis racket which is strung in a manner as taught by this invention.

FIG. 2 illustrates a tennis racket which has been woven in accordance with one embodiment of this invention. It will be seen that every other horizontal string 20, 22, 24, by way of example, starting with the second string from the bottom string has been eliminated. Also, the first, third and fifth vertical strings, (strings which extend in the direction of the handle) respectively 26, 28, 30, and 26*a*, 28*a*, 30*a*, have been removed respectively from the left and right sides of the racket. The numbering of these strings is based upon calling the string closest to the racket frame as number 1. Also, if desired, but not required, the strings which are employed, before stringing may be coated with a coating on the order of 1 or 2 mils in thickness with a material such as urethane, by way of example.

Figure 3:
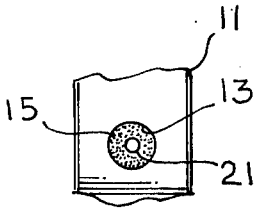
FIG. 3 is a cross sectional fractional view of a hole in the frame and the region therearound.

FIG. 3 is a cross section along the lines 3—3 of FIG. 2 and is exemplary of the holes in the frame of the racket and illustrates that the openings such as 13 in the racket frame 11, may be filled with a resilient material, such as foam rubber, 15, and the strings, such as 21 pass therethrough. This is optional however, and may be used to aid in impact absorption.

The result achieved by a tennis racket construction in accordance with this invention, is to provide considerable absorption of the impact resulting from striking the ball with the strings in the tennis racket frame. Therefore, there is a minimal transmission of the force of impact to the elbow, thus minimizing the chances for causing "tennis elbow." Also, the tennis ball remains longer in contact with the strings and thus a better opportunity for controlling the ball is provided. That is, if a person desires to give the ball "spin" this can be better done when the ball is in contact with the racket for a longer period of time than for a shorter period of time. Also, fewer strings in contact with the ball reduces the friction between strings and ball, resulting in better energy transfer.

Finally, the tennis ball comes off the racket at a higher velocity than it does from a racket which is strung in the presently accepted manner, since, in addition to the velocity with which the racket itself is moved, there is less loss due to friction and the strings of the racket, which are stretched more when they are constructed in accordance with this embodiment of the invention than otherwise, snap back and the velocity of their elastic return is thus added to whatever other velocity has been applied to the ball.

Figure 4:
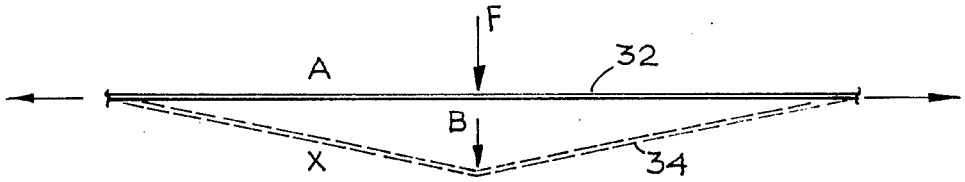
FIG. 4 is a schematic diagram representing a single stretched string.

To illustrate the fact that a construction in accordance with this invention will cause a greater absorption of a force of impact by a ball upon the strings of a tennis racket, consider the following. In FIG. 4, 30 is a stretched vertical center string that is stretched with the usual force (between 50 and 60 pounds) with which strings are stretched in a racket. Assume that there are no cross strings to support the center string. Assume further that a ball strikes the center string and the force of the ball is applied to the center, as shown by the arrow labelled with the letter F. The string will stretch or elongate, as represented by the dotted lines 34. It will be seen that an imaginary triangle is formed having sides A, B and X where A is one half of the string before the ball is impacted, X is one half of the string after being impacted by the ball and B is the largest string displacement distance. It has been found that, in response to a 1 pound load, a tennis string (either nylon or gut) elongates approximately 0.007 inches.

The length of the string stretch per pound of force has been obtained as a result of numerous measurements of standard 15 gauge light (15L) gut and nylon strings made by various manufactures. The numbers here are given to illustrate the concept to be described and are not to be considered as a limitation on the invention. The concept holds true as long as the strings remain within their elastic deformation limits within which they will obey Hooke's law of elasticity. With this in mind, string diameter, or tension, or material are relatively inconsequential. Velocity of the ball does not affect the conclusions to be reached except when it causes sliding of the strings. On the assumption that the ball strikes the racket perpendicularly, the velocity of the ball has no effect on the results given in the discussion that follows.

It should be clearly understood that the principle illustrated in FIG. 4 and explained here is true whether the string 32 is considered as being supported between the sides of a racket or by two adjacent, spaced, supportive strings extending in the same plane as string 32, but at right angles thereto.

In this example, assume that the distance A equals 5 inches, and the distance B, caused by the impact of the ball, is 1 inch. Accordingly, by solving the right triangle for the length of X, it is found that X equals 5.099 or approximately 5.1 inches. Therefore the elongation caused by the force of the ball is 0.1 inch. Thus, on the assumption that to elongate a string 0.007 in a 1 pound force must be applied, the force F that was applied to obtain this elongation equals $0.1/0.007 = 14.28$ pounds. This of course is approximate because it is really a vector sum, but the angle between the sides A and X is small, so the approximation is fairly accurate.

Figure 5:
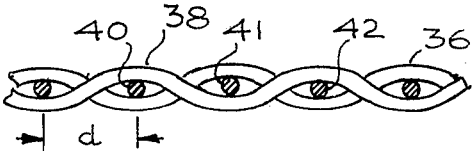
FIG. 5 is a cross section of the string arrangement of a racket.

Now considering a tennis racket which is strung in the conventional fashion, a cross sectional view through the strings has the appearance represented by FIG. 5, wherein the strings 36, 38 represent the strings going in one direction and the cross strings are threaded therethrough as represented by 40, 42 for example. The spacing *d*, (shown in FIG. 5) between the cross strings is approximately 0.375 inches, as shown on the drawing. Now considering FIG. 6, one of the strings 38, has been removed for clarity. Each cross string, in response to the full impact provides a resistance force to the applied load F. Thus, as shown in the drawing, half the applied load is applied to the cross strings 40 and 42. Resistance thereto is provided by the cross string 41. The foregoing assumes almost complete load taken up by the strings 40 and 42, which is almost true, since they take up to 80% of the load.

Figure 6:
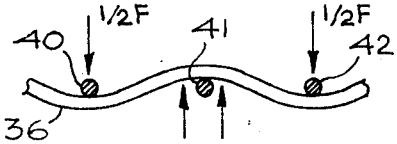
FIG. 6 exemplifies a single string in the arrangement illustrated in FIG. 5.
Figure 7:
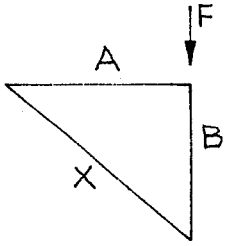
FIG. 7 is an imaginary triangle formed by a stretched string in its unstretched state.

Assume, again, that a right triangle is formed similar to the one shown in FIG. 4, when a ball impacts the strings of a racket (woven in the manner such as shown in FIG. 6). The imaginary right triangle, this time is represented by FIG. 7, but the distance A, corresponding to the side A in FIG. 4 is 0.375 inches which is the distance between interwoven cross strings. The distance B1 is corresponding to B in FIG. 4, and is assumed to be one inch again. By simple geometry, XI, the elongated string (corresponding to X in FIG. 4), has a length of 1.068 inches. Thus, this time, the elongation which the string A1 undergoes to attain the length of X1 equals $1.068 - 0.375 = 0.693$ inches. The force required to cause a string to elongate 0.693 inches equals 99 pounds. This is for only one string. The ball interacts with at least two to four strings.

In a racket in which strings have been removed, in accordance with the teachings of this invention, every other one of the horizontal strings has been removed and the first, third and fifth vertical strings on the left and right sides of the racket also. More strings would be removed except that the elastic limit of the strings is approached and it is important that the remaining strings in the racket stay within their elastic limits and do not permanently deform in response to striking a tennis ball.

Because of the number of strings removed from a racket in accordance with this invention, the distance A1, shown in FIG. 7 is increased from ⅜ inch to ¾ inch in one direction. Calculating the force required to stretch a string one inch, provides an elongation equal to 0.5 inch for which a force of approximately 70 pounds is required, instead of the 99 pounds required as shown in the normally strung racket. Thus, for the same deflection, approximately 30% less force is required, or for the same force, 30% more deflection will occur in a racket made in accordance with this invention. In view of the increase in deflection made by an impacting ball, the ball will remain in contact with the racket for a longer time. Since the racket serves to decelerate the ball, the time the ball is in contact with the racket is increased by approximately 90% over the time it would otherwise be in contact with the racket. As a result, total impact absorption is spread over a much greater time base and the shock resulting from the impact of the ball and the racket is reduced considerably.

While the embodiment of the invention shown in FIG. 2 performs as described above, it has been found that some string motion, in the plane of the racket occurs about the center of the racket in response to ball impact. This has the effect of eventually causing string breakage, since the strings rub upon one another. In order to avoid this, while still maintaining the performance of the racket as previously described, four more horizontal strings are added to the center area and the horizontal strings on either side of the center area are tied to the vertical strings with which they are woven.

Figure 8:
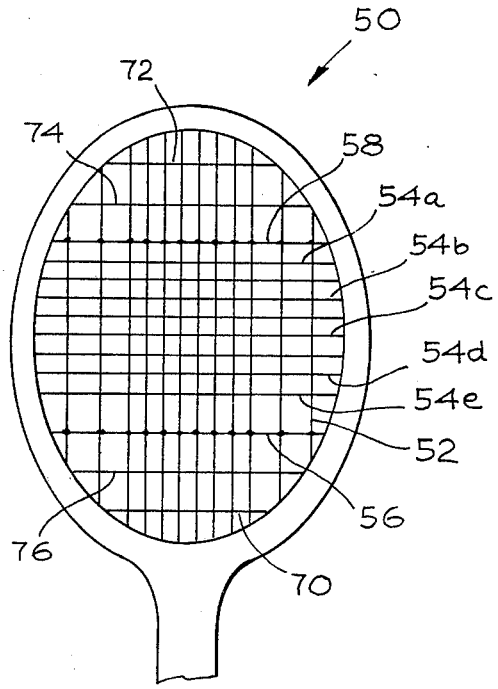
FIG. 8 illustrates another manner for stringing a racket in accordance with this invention.

This is illustrated in FIG. 8 where in the racket frame 50, the same number of vertical strings 52, for example, are strung, (extending in the same direction as the racket handle), and similarly distributed over the racket frame, as was shown and described in connection with FIG. 2. That is, the first, third, and fifth strings, (26, 28, 30, 26*a*, 28*a*, 30*a*, in FIG. 1), counting respectively from the left and right sides of the racket are omitted, thus leaving the remaining strings adjacent the outsides of the racket more widely spaced apart than in the standard racket, shown in FIG. 1.

Figure 9:
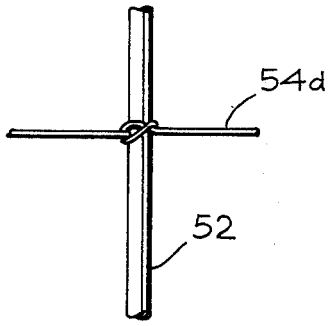
FIG. 9 illustrates tying of strings.

However, four more horizontal strings than were shown in FIG. 2, strings 54*a* through 54*d*, are added at the center region of the racket, being placed alternately with the previously shown horizontal strings at the center. The addition of those four strings prevents the ball from causing the strings disposed at the center region of the racket from spreading or moving in response to ball impact and thereby prevents string breakage. In addition to the foregoing, horizontal strings 56 and 58 are tied to vertical strings wherever they intersect. This is represented by an enlarged view in FIG. 9 of the intersection of a vertical and horizontal string respectively 60, 62 and a tying string 64, being wrapped around the intersection. The ties prevent strings 54, 58 from sliding.

By way of illustration of an embodiment of the invention, to exemplify the disposal of the strings in a tennis racket, but not to serve as a limitation on this invention, the following example is submitted. The top and bottom horizontal strings shown in FIG. 8, respectively 70, 72, are one inch away from the inside of the racket frame at the greatest distance therefrom. The next adjacent top and bottom horizontal strings, respectively 74, 76, are spaced one inch away from strings 70, 72. Horizontal strings 74 and 76 are one inch away respectively from respective adjacent strings 58, 56. String 54*a* is ¾ inch away from string 58, but the next seven adjacent horizontal strings are ⅜ inch away from each other. However, string 54*e*, the last of these seven strings, is ¾ inch away from string 56.

The eight centermost vertical strings are 182 inch away from each other. The remaining two vertical strings on either side of the eight centermost vertical strings are spaced one inch apart from each other and the eight centermost strings.

By moving the outermost horizontal and vertical strings away from the racket frame and reducing the number of support strings there, loading caused by off center impacts with the ball is reduced, because, as has been shown, and discussed in connection with FIGS. 2 through 6, there is a better absorption of the impact by the ball on these strings. The strings at the center of the racket form ⅜ inch squares. The strings in a standard racket form 7/16 inch squares, which are slightly larger. However, a center impacted racket distributes the impact uniformly around the frame, as a result of which the forces to be absorbed, being distributed over a larger area than a side impacted racket, are smaller, and thus much less harmful to the arm of a player.

Figure 10:
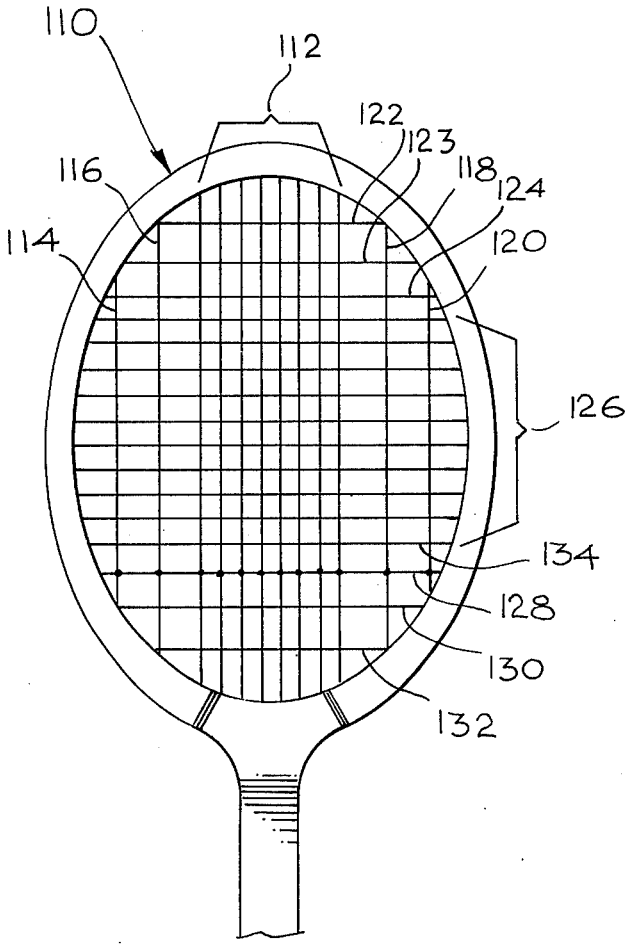
FIG. 10 illustrates a preferred arrangement for stringing a tennis racket.

A standard tennis racket has 18 vertical strings and 20 horizontal strings. FIG. 10 shows a preferred embodiment of this invention wherein there are 16 horizontal strings and 12 vertical strings strung on the racket frame. The racket frame 110 is a standard size racket frame. There is a central group of vertical strings 112, for example, containing eight vertical strings, placed ⅜ of an inch apart, forming a vertical string central group. By vertical strings is meant strings which extend in the same direction as the racket handle. On each side of the central group of vertical strings 112, there are two vertical strings, respectively 114, 116, 118 and 120. Strings 116 and 118 are spaced one inch from the nearest vertical string in the central group. Strings 114 and 120 are respectively one inch from strings 116 and 118. Strings 114 and 120 are also one inch away from the racket frame at its widest dimension.

The top horizontal string 122, is one inch below the racket frame at its widest vertical dimension. The horizontal string 123 adjacent the top horizontal string 122 is spaced ¾ of an inch away. The next adjacent string 124 is spaced ⅝ of an inch away. The next 10 strings 126, or the central horizontal group are spaced between 7/16 to ⅜ of an inch away from each other. The 14th horizontal string 128 is approximately ¾ of an inch away from the lowest string of the central horizontal group of strings. The 15th horizontal string 130 is ⅞ of an inch away from the 14th string. The 16th string 32 is 1 inch away from the 15th string. Additional strings are added at the top of the racket to provide a more "lively" projection of the ball when it is struck within the region of the racket near the top.

String 128 is tied to the vertical strings which intersect it. The tie prevents the strings from sliding. By moving the outermost vertical strings as well as the outermost lower horizontal strings away from the racket frame, and reducing the number of support strings, any loading caused by off-center impact with the ball is reduced. This arises because the usual stiffening of the strings is reduced by virtue of the fewer number of strings, whereby the force required to stretch a string, in response to a ball impact is reduced. Care must be taken to see that the strings will not stretch beyond their elastic limits, and that is why the number of strings cannot be reduced to too great an extent.

In view of the fact that the strings are permitted to stretch more than what occurs with the normally strung racket, the ball will remain in contact with the racket strings for a longer time. Since the racket strings serve to decelerate the ball, the time the ball is in contact with the racket strings is substantially increased. As a result, total impact absorption is spread over a much greater time base and the shock resulting from the impact of the ball and the racket is reduced considerably.

The string 122 and string 123 immediately adjacent thereto, or two top strings, have been added to provide a better performance by reducing the string deformation in this area whereby the "dead" feeling, which would otherwise occur when a ball impacts the top area, is eliminated.

The strings in a standard racket form 7/16 an inch squares over the entire racket. The strings in a racket in accordance with this invention at the center form ½ by ⅜ inch squares, and, the square sizes are obviously greater at the sides and bottom where the strings are spaced one inch apart. As indicated, it is this reduction in the number of strings and their wider spacing which permits better impact absorption with a considerably reduced transmittal of this impact to the arm of the player.

There has accordingly been described and shown herein a novel and useful method and means for stringing a tennis racket whereby reducing the number of strings below what they are normally, while still leaving enough strings so that they will not be deformed beyond their elastic limits in response to ball contact. Since the time the ball is in contact with the racket strings is increased, the force of the impact which is transmitted to the arm of the player is considerably reduced.

I claim:

1. A racket having improved ball impact properties comprising a frame defining a central opening.

a handle extending outwardly from said frame, first string means forming a vertical plurality of strings extending in the direction of said handle, spaced over said central opening and being attached to said frame under tension through holes in said frame, said vertical plurality of strings including a vertical central group of substantially equally spaced strings, disposed on either side of the center line extending through the handle of said racket, a first pair of vertical strings positioned at one side of said vertical central group of strings, one of the strings in said first pair being spaced one inch from the nearest string of said central group of strings, the other string of said first pair being spaced one inch from said one of said first pair of strings, and a second pair of vertical strings positioned on the other side of said central group of strings, one of said second pair being one inch from the nearest string in said central vertical group of strings, the other string of said second pair being spaced one inch from said one string of said second pair of strings, second string means forming a horizontal plurality of strings extending at right angles to said vertical plurality of strings, spaced over said central opening and being attached to said frame under tension through holes in said racket, said second string means including, a first group of horizontal strings evenly spaced from one another within the central opening of said racket, the first string of said first group of strings being positioned substantially 2⅜ inches below the top of said racket, a first group of three strings spaced between the lowermost of said first group of horizontal strings, and said racket handle, a first of said first group being spaced substantially ¾ of an inch away from said lowermost of said horizontal group of strings, the next string of said first group being spaced substantially ⅞ of an inch away from the first string, and the last string of said first group being spaced one inch away from said next string, and a second group of strings spaced between the top most of said first group of horizontal strings and the top of said racket, a first string of said second group being spaced substantially ⅝ of an inch away from said topmost string of said first group, and a second string of said second group being spaced substantially ¾ of an inch away from said first string of said second group of horizontal strings.

2. The claim as recited in claim 1 wherein the vertical central group of strings are spaced substantially ¾ of an inch from one another and the strings of said first group of horizontal strings are spaced between 7/16 to ⅜ of an inch from one another.

3. A racket as recited in claim 1 wherein there are a total of 12 vertical strings and 16 horizontal strings.

4. A racket as recited in claim 1 wherein the third from bottom horizontal string of the racket is tied to the vertical strings which intersect therewith.

5. A racket having improved ball impact absorption properties comprising:

a frame defining a central opening and having a handle extending from one side thereof, first string means forming a first plurality of strings, second string means forming a second plurality of strings, said first and second plurality of strings being fastened to said frame through a plurality of holes therethrough, the strings in said first plurality of strings being spaced apart and parallel to each other and including a horizontal central group of strings and a top two strings and a bottom three strings positioned on either side of said horizontal central group of strings, the string in said top two strings and in the bottom three strings which is adjacent to said horizontal central group of strings being spaced on the order of three quarters of an inch from the nearest string of said horizontal central group, the remaining strings of said top two and bottom three strings being spaced on the order of 1 inch from one another, the strings in said second plurality of strings being spaced apart, parallel to each other, woven through and orthogonal to said first plurality of strings, and including a vertical central group of strings and a left two strings and a right two strings positioned on either side of said vertical central group of strings, the strings in said left and right two strings each being spaced on the order of one inch away from one another, the strings of said left and right two strings closest to the strings of said vertical central group of strings being spaced one inch away therefrom, and said horizontal central group of strings and said vertical central group of strings being spaced closer together than the remaining strings of said first and second plurality of strings.

6. A racket having improved ball impact properties comprising:

a frame defining a central opening, a handle extending outwardly from said frame, first string means forming a vertical plurality of strings extending in the direction of said handle, spread over said central opening and being attached to said frame under tension through holes in said frame, said vertical plurality of strings including a first three strings spaced on the order of one inch from one another and positioned on one side of a vertical central group of strings, and a last three strings spaced on the order of one inch from each other and positioned on the other side of said vertical central group of strings, the centers of the strings in said first and last three strings nearest the frame being on the order of one inch distance from said frame, the remaining strings of said vertical central group of strings, including the strings in said first and last three strings closest to said remaining strings, being substantially evenly spaced from one another, second string means forming a horizontal plurality of strings extending orthogonal to and being interlaced with said vertical plurality of strings, spread over said central opening and being attached to said frame under tension through holes in said frame, said horizontal plurality of strings including a first three strings spaced on the order of 1 inch from one another and positioned on one side of a horizontal central group of strings, and a last three strings spaced on the order of one inch from each other and positioned on the other side of said horizontal central group of strings, the one of said last three strings closest to the strings of said horizontal plurality of strings being on the order of ¾ of an inch therefrom, and the remaining strings of said horizontal central group of strings including the one of said first three strings closest thereto being substantially evenly spaced from one another.

7. A racket as recited in claim 6, wherein said vertical plurality of strings contains 12 strings, and said horizontal plurality of strings contains 14 strings.

8. A racket as recited in claim 6, wherein the strings in said first and last three strings, there is included, means for tying said horizontal plurality of strings which are adjacent to said horizontal central group of strings, to the strings of said vertical plurality of strings where they intersect.

9. A tennis racket having improved ball impact absorption properties comprising a frame defining a central opening, a handle extending outwardly from said frame, first string means forming twelve parallel strings spaced over said opening and extending in the direction of said handle, said first string means including eight strings disposed evenly about the central opening, and two strings on either side of said eight strings, said eight strings being spaced on the order of three-eighths of an inch and more closely together than said two strings on either side, and second string means forming fourteen parallel strings spaced over said opening and extending at right angles to and being interlaced with said first string means, said second string means including eight strings evenly disposed about the central opening, and three strings on either side of said eight strings, said eight strings being spaced on the order of three-eighths of an inch and more closely together than said three strings on either side, the strings of said first and second string means which are closest to the racket frame being located so that their centers are spaced from the frame a distance on the order of their spacing to the next nearest string.

10. A tennis racket as recited in claim 9 wherein one string in each of the three strings on either side of said eight strings which is closest to said eight strings, each is tied to the strings of the first string means where they intersect.

* * * * *